US009014589B2

(12) United States Patent
Taguchi et al.

(10) Patent No.: US 9,014,589 B2
(45) Date of Patent: Apr. 21, 2015

(54) IMAGE FORMING APPARATUS

(75) Inventors: Noriaki Taguchi, Osaka (JP); Shinji Nakazawa, Osaka (JP); Shinichi Takeda, Osaka (JP); Yoshitaka Okahashi, Osaka (JP); Norio Tomita, Osaka (JP); Kohichi Yamauchi, Osaka (JP); Hiroki Kanemitsu, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 213 days.

(21) Appl. No.: 13/094,889

(22) Filed: Apr. 27, 2011

(65) Prior Publication Data

US 2011/0274463 A1 Nov. 10, 2011

(30) Foreign Application Priority Data

May 10, 2010 (JP) ..... 2010-108532

(51) Int. Cl.
*G03G 21/20* (2006.01)

(52) U.S. Cl.
CPC ..... *G03G 21/206* (2013.01)

(58) Field of Classification Search
CPC ..... G03G 21/20; G03G 21/206
USPC ..... 399/91, 92, 94
See application file for complete search history.

(56) References Cited

U.S. PATENT DOCUMENTS

| | | | | |
|---|---|---|---|---|
| 5,315,350 | A * | 5/1994 | Hirobe et al. | 399/69 |
| 5,887,226 | A | 3/1999 | Taki | |
| 2002/0057935 | A1* | 5/2002 | Makino | 399/328 |
| 2005/0063154 | A1* | 3/2005 | Pleines et al. | 361/690 |
| 2005/0220477 | A1* | 10/2005 | Nakane | 399/92 |

FOREIGN PATENT DOCUMENTS

| | | | | |
|---|---|---|---|---|
| JP | 04-149578 | | 5/1992 | |
| JP | 09-222760 | | 8/1997 | |
| JP | 10-143053 | | 5/1998 | |
| JP | 2003-316178 | | 11/2003 | |
| JP | 2004-138844 | | 5/2004 | |
| JP | 2004-151240 | | 5/2004 | |
| JP | 2005031562 | A * | 2/2005 | G03G 15/20 |
| JP | 2007-033943 | | 2/2007 | |
| JP | 2008-096879 | | 4/2008 | |
| JP | 2008158409 | A * | 7/2008 | |

* cited by examiner

*Primary Examiner* — David Gray
*Assistant Examiner* — Thomas Giampaolo, II
(74) *Attorney, Agent, or Firm* — Renner, Otto, Boisselle & Sklar, LLP

(57) ABSTRACT

An image forming apparatus provided with a resin frame made of a resin, an image forming unit and a fixing unit includes a duct for allowing air to flow between the image forming unit and the fixing unit. The resin frame includes a main frame to which the image forming unit is attached, and a fixing unit attachment frame that is separate from the main frame and to which the fixing unit is attached, and the fixing unit attachment frame has a duct portion that constitutes at least one part of the duct.

7 Claims, 6 Drawing Sheets

IMAGE FORMING APPARATUS

BACKGROUND OF THE INVENTION

This application claims priority under 35 U.S.C. §119(a) on Patent Application No. 2010-108532 filed in Japan on May 10, 2010, the entire contents of which are herein incorporated by reference.

The present invention relates to an image forming apparatus provided with a resin frame made of resin, image forming units and a fixing unit.

A frame that constitutes the basic structure of an image forming apparatus such as a copying machine, a printer, a facsimile machine or a digital multifunction machine is conventionally a metal frame structure made by assembling conventional pressed metal parts or metal based steel materials by joining or welding.

In a recent trend of reducing the production cost of image forming apparatuses, conventional metal frames are not sufficiently profitable. Moreover, there is a great demand for compactness and lightness of weight, which requires simplicity of structures and reduction of the number of parts. Considering these circumstances, there is a limit in compactness and lightness of metal frame structures.

Resin frames made of resin may be adopted in view of cost reduction, compactness and lightness of weight required for frame structures, but in this case there may be problems as follows.

A complicated die for molding a resin frame is needed when producing resin frames. In particular, when a frame for an image forming apparatus compatible with a large image formation size of A3 or larger is required to be produced with resin, a large die is needed, which increases die preparation time, die cost and so on.

For an image forming apparatus provided with a fixing unit and image forming units (process units) including a photosensitive unit, a charging unit and a development unit, a structure for suppressing heat transmission from the fixing unit to the image forming unit has been proposed.

For example, JP H10-143053A (Patent Document 1) and JP H9-222760A (Patent Document 2) disclose image forming apparatuses provided with a duct in a space between the image forming unit and the fixing unit.

However, in the image forming apparatuses disclosed in Patent Documents 1 and 2, heat transmission from the fixing unit to the image forming unit can be suppressed, but there is no consideration to the problem of the necessity of a complicated die for resin frame molding that is compatible with a large resin frame.

Therefore, it is an object of the present invention to provide an image forming apparatus provided with a resin frame made of resin, an image forming unit and a fixing unit that can suppress heat transmission from the fixing unit to the image forming unit while simplifying a die for molding the resin frame.

SUMMARY OF THE INVENTION

In order to solve the above problems, the present invention provides an image forming apparatus, that includes a resin frame made of a resin, an image forming unit, a fixing unit, a duct for allowing air to flow between the image forming unit and the fixing unit. The resin frame includes a main frame to which the image forming unit is attached, and a fixing unit attachment frame that is separate from the main frame and to which the fixing unit is attached, and the fixing unit attachment frame has a duct portion that constitutes at least one part of the duct.

According to the present invention, since the resin frame includes the main frame to which the image forming unit is attached, and the fixing unit attachment frame that is separate from the main frame and to which the fixing unit is attached, the main frame that constitutes part of the resin frame can be molded with a die for the main frame, the fixing unit attachment frame that constitutes part of the resin frame can be molded with a die for the fixing unit attachment frame that is different from the die for the main frame. This can simplify the die structure for molding the resin frame. In addition, the duct is provided to allow air to flow between the image forming unit, for example, image forming units in the vicinity of the fixing unit, and the fixing unit. Therefore, heat transmission from the fixing unit to the image forming unit can be suppressed. Furthermore, the fixing unit attachment frame has the duct portion constituting at least a portion of the duct, and therefore the strength of the fixing unit attachment frame can be improved.

In the present invention, the main frame and the fixing unit attachment frame may be formed of the same kind of resin.

With this feature, the main frame and the fixing unit attachment frame are able to have the same shrinkage rate by forming the main frame and the fixing unit attachment frame of the same kind of resin. This makes it possible to reduce deformation between the main frame and the fixing unit attachment frame that is caused by heat of the fixing unit attachment frame.

In the present invention, the fixing unit attachment frame may include a main frame attachment portion for attachment to the main frame and a fixing unit attachment portion for attachment to the fixing unit at a different position from the main frame attachment portion.

With this feature, since the fixing unit attachment frame has the main frame attachment portion and the fixing unit attachment portion, which is located in a different position from the main frame attachment portion, it is possible for the fixing unit attachment frame to be attached to the main frame through the main frame attachment portion, and to be attached to the fixing unit through the fixing unit attachment portion at a different position from the main frame attachment portion. Thus, the main frame can be a common component used for various models of the fixing unit having different structures, which accomplishes cost reduction.

In the present invention, the fixing unit attachment frame may be provided with a driving member for rotating the fixing unit.

With this feature, since the driving member is provided in the fixing unit attachment frame, by varying the driving member with models having different process speeds, the main frame can be a common component used for models having different process speeds, which accomplishes cost reduction.

In the present invention, the fixing unit attachment frame may have at least one face that constitutes part of the duct, and the at least one face may serve also as a reinforcing portion.

With this feature, in the fixing unit attachment frame, the reinforcing portion that is served by the at least one face that constitutes part of the duct further improves the strength of the fixing unit attachment frame.

In the present invention, the duct portion may be configured to be a box-like shaped duct portion that is open in one direction.

With this feature, the duct portion has a box-like shape that is open in one direction, and therefore the strength of the fixing unit attachment frame having the box-like shaped duct portion can be improved.

In the present invention, the fixing unit may have a fixing roller and have a shape that is elongated to the axis direction of the fixing roller, and the duct may be provided adjacent to the fixing unit and extending in the length direction of the fixing unit.

With this feature, the duct that is provided adjacent to the fixing unit and extending in the length direction of the fixing unit makes it possible to cool the fixing unit entirely along the length direction.

In the present invention, a rib having a curvature in an air flowing direction may be provided inside the duct, and the rib may be formed integrally with the duct.

With this feature, the rib has a curvature in the air flowing direction, which makes a configuration in which air flow is hardly interrupted by the rib. Furthermore, the surface area of the rib can be increased, and air can come in contact with the surface of the rib efficiently, which improves the heat dissipation effect due to the rib. In addition, the rib and the duct portion are formed integrally into one piece, which makes it possible to improve the strength of the fixing unit attachment frame as well as the strength of the duct.

REFERENCE SIGNS LIST

Figure 1:
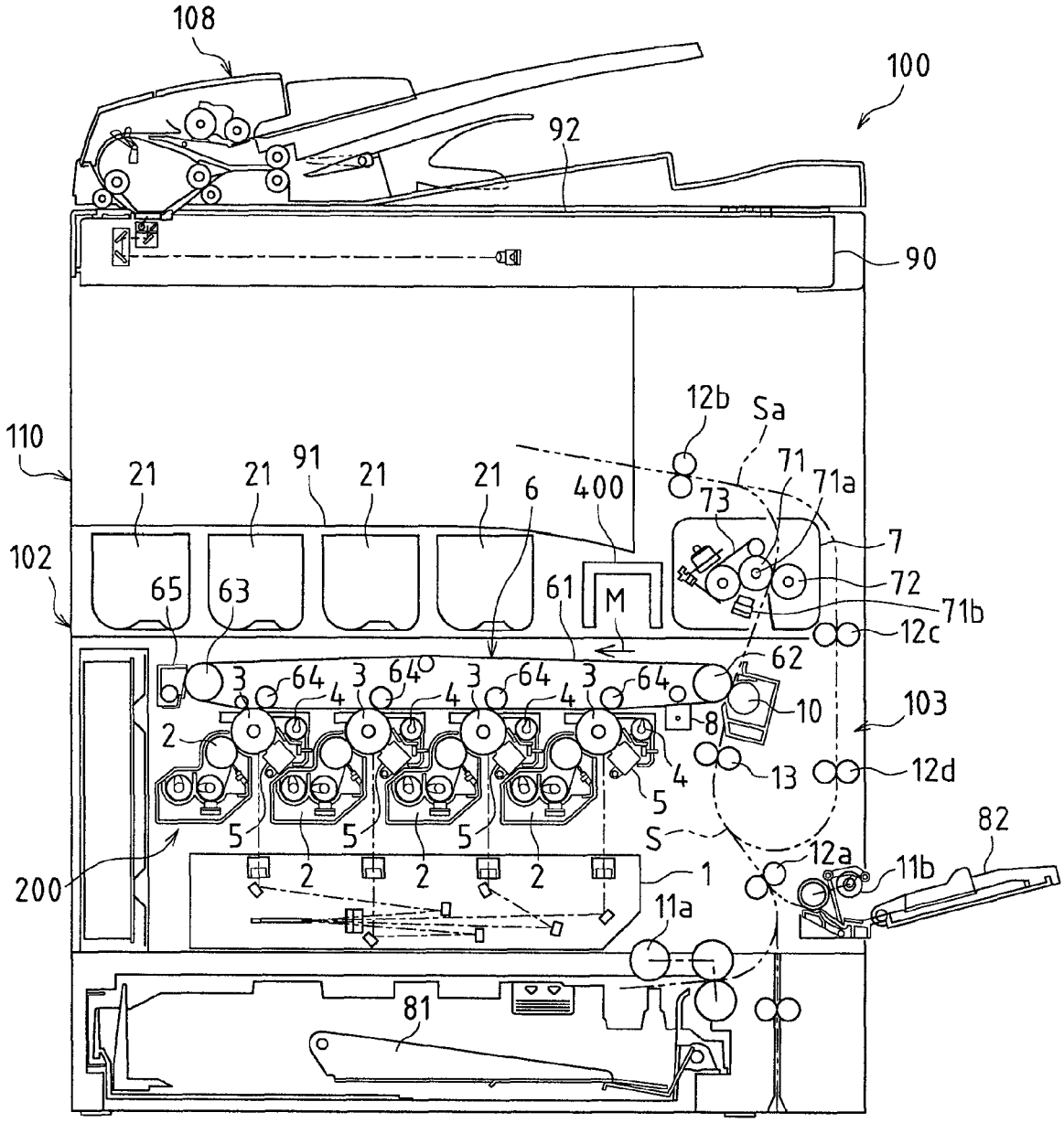
FIG. 1 is a schematic cross-sectional view of an image forming apparatus of an embodiment of the present invention when viewed from the front.

7 fixing unit
70 driving member
71 heat roller
72 pressing roller
100 image forming apparatus
110 apparatus body
200 image forming unit
300 resin frame
310 main frame
320 fixing unit attachment frame
320*a* main frame attachment portion
320*b* fixing unit attachment portion
321 duct portion
321*a* opening portion
321*b* inner upper face
321*c* first inner side face
321*d* second inner side face
400 duct
420 rib
X width direction of the apparatus body
Y depth direction of the apparatus body
Z vertical direction

DESCRIPTION OF THE PREFERRED EMBODIMENTS

Hereinafter, embodiments of the present invention will be described with reference to the accompanying drawings. The embodiments described below are only examples in which the present invention is embodied, and are not intended to limit the technical scope of the present invention.

<Outline of General Structure of Image Forming Apparatus>

FIG. 1 is a schematic cross-sectional view of an image forming apparatus 100 according to an embodiment of the present invention when viewed from the front.

The image forming apparatus 100 shown in FIG. 1 is a color image forming apparatus that forms multicolor or monochrome images on a sheet such as recording paper (hereinafter, referred to as recording sheet) in accordance with image data transmitted from the outside. The image forming apparatus 100 includes an original reading device 108 and a apparatus body 110, and the apparatus body 110 includes an image forming portion 102 and a sheet conveying system 103.

The image forming portion 102 includes a light exposure unit 1, a plurality of development units 2, a plurality of photosensitive units 4, an intermediate transfer belt unit 6, a pre-transfer charging unit 8, a plurality of toner cartridge units 21, and a fixing unit 7. In this embodiment, the light exposure unit 1, the development units 2, the photosensitive units 4, the intermediate transfer belt unit 6, and the toner cartridge units 21 function as a plurality of removable image forming units 200 that have different image forming operations. It should be noted that the photosensitive unit 4 is formed as an integral unit in which a photosensitive unit, a charging unit and cleaning unit are combined in this embodiment.

The sheet conveying system 103 includes a paper feed tray 81, a manual paper feed tray 82 and a paper discharge tray 91.

An original placement plate 92 made of transparent glass on which an original (document sheet) is placed is provided above the apparatus body 110, and an optical unit 90 for reading an original is provided below the original placement plate 92. The original reading device 108 is provided above the original placement plate 92. The original reading device 108 conveys automatically an original onto the original placement plate 92. The original reading device 108 is attached pivotally to the apparatus body 110 with the front side openable, and an original can be placed manually after exposing the surface of the original placement place 92. It should be noted that in this embodiment, the front side of the apparatus body 110 is an attachment side from which the toner cartridge units 21, the photosensitive units 4, the development units 2, and the pre-transfer charging unit 8 can be removed.

The original reading device 108 can read an original automatically conveyed or an original placed on the original placement plate 92. The entire image of the original read by the original reading device 108 is transmitted as image data to the apparatus body 110 of the image forming apparatus 100, and an image formed based on the image data is recorded on a recording sheet in the apparatus body 110.

The image data that can be processed in the image forming apparatus 100 is that corresponding to color images using multiple colors (black (K), cyan (C), magenta (M), yellow (Y) in this embodiment). Therefore, for each unit group of the development units 2, the photosensitive units 4 and the toner cartridge units 21, a plurality of units (four in this embodiment, respectively corresponding to black, cyan, magenta and yellow) are provided, such that images of multiple kinds (four kinds in this embodiment) corresponding to four colors can be formed, and accordingly an image station is configured for each color (four colors in this embodiment).

In the photosensitive units 4, the chargers 5 are charging means for uniformly charging the surface of photosensitive drums 3 to a predetermined potential, and for the chargers 5, chargers of roller type or brush type, which are contact type, can be used, as well as chargers as shown in FIG. 1.

The light exposure unit 1 is configured in a form of a laser scanning unit (LSU) provided with a laser irradiating portion and reflection mirrors. The light exposure unit 1 is provided with a polygon mirror scanned by a laser beam, and optical elements such as lenses or mirrors for guiding the laser light reflected by the polygon mirror to the photosensitive drum 3. For the light exposure unit 1, other concepts can be used, such as a concept employing a writing head in which optical elements such as EL (electroluminescence) elements or LEDs (light-emitting diodes) are aligned in an array.

The light exposure unit 1 irradiates the photosensitive drums 3 that are charged in accordance with input image data with light so that an electrostatic latent image in accordance with the image data is formed on the surfaces of the photosensitive drums 3.

The toner cartridge units 21 are units containing toner, and are configured such that the toner is supplied to the development baths of the development units 2. In the apparatus body 110 of the image forming apparatus 100, the toner supplied from the toner cartridge units 21 to the development baths of the development units 2 is controlled such that the toner concentration of a developer in the development baths is constant.

The development units 2 make the electrostatic latent images formed on the respective photosensitive drums 3 visible with four color toners (Y, M, C, and K). The photosensitive units 4 have a cleaning function of removing and recovering toner that is left on the surfaces of the photosensitive drums 3 that have undergone development and image transfer.

The intermediate transfer belt unit 6 arranged above the photosensitive drums 3 includes an intermediate transfer belt 61 serving as an intermediate transfer member, an intermediate transfer belt driving roller 62, an intermediate transfer belt idle roller 63, a plurality of intermediate transfer belt rollers 64, and an intermediate transfer belt cleaning unit 65.

For the intermediate transfer belt rollers 64, four rollers are provided corresponding respectively to colors Y, M, C, and K. The intermediate transfer belt driving roller 62 supports the intermediate transfer belt 61 in cooperation with the intermediate transfer belt idle roller 63 and the intermediate transfer belt rollers 64 such that the intermediate transfer belt 61 is in tension. When the intermediate transfer belt driving roller 62 is rotated, then the intermediate transfer belt 61 is revolved in the movement direction (direction indicated by arrow M in FIG. 1), which causes the intermediate transfer belt idle roller 63 and the intermediate transfer belt rollers 64 to rotate idly.

The intermediate transfer belt rollers 64 are supplied with a transfer bias for transferring a toner image formed on the photosensitive drums 3 onto the intermediate transfer belt 61.

The intermediate transfer belt 61 is provided in such a manner that it is in contact with each of the photosensitive drums 3. A toner image of each color formed on the respective photosensitive drums 3 is sequentially transferred to the intermediate transfer belt 61 so as to be superimposed one after another, so that a color toner image (multicolor toner image) can be formed on the surface of the intermediate transfer belt 61. The intermediate transfer belt 61 is formed by an endless belt made of a film having a thickness of about 100 μm to 150 μm.

Toner images are transferred from the photosensitive drums 3 to the intermediate transfer belt 61 by means of the intermediate transfer belt rollers 64 that are in contact with the back face of the intermediate transfer belt 61. The intermediate transfer belt rollers 64 are supplied with a high voltage transfer bias (high voltage having an opposite polarity (+) to the polarity (−) of the charged toner) for transferring toner images. Each intermediate transfer belt roller 64 is made by forming its core with a metal (e.g., stainless steel) shaft having a diameter of 8 mm to 10 mm and covering the surface of the core with a conductive elastic material (e.g., resin materials such as EPDM (ethylene propylene diene rubber) or foamed urethane). The intermediate transfer belt rollers 64 serve as transfer electrodes that apply a high voltage uniformly to the intermediate transfer belt 61 with the conductive elastic material. Although roller-like transfer electrodes are used as the transfer electrodes, other transfer electrodes, for example, brush-like transfer electrodes can be used.

As described above, toner images that are made visible in accordance with the color phases on the respective photosensitive drums 3 are layered on the intermediate transfer belt 61. The toner images layered on the intermediate transfer belt 61 are transferred onto a recording sheet by a transfer roller 10 constituting a second transfer mechanism portion disposed in a contact position in which the recording sheet is in contact with the intermediate transfer belt 61, by means of the rotational movement of the intermediate transfer belt 61. However, as the configuration of the second transfer mechanism portion, not only transfer rollers, but also other transfer configurations such as those employing corona chargers or transfer belts can be used.

At this time, the transfer roller 10 is supplied with a voltage (high voltage having an opposite polarity (+) of the polarity (−) of the charged toner) for transferring toner onto a recording sheet in a state where a transfer nip is formed between the transfer roller 10 and the intermediate transfer belt 61. The transfer nip is formed between the transfer roller 10 and the intermediate transfer belt 61 by the transfer roller 10 and the intermediate transfer belt driving roller 62 pressing against each other. In order to obtain the transfer nip steadily, either one of the transfer roller 10 and the intermediate transfer belt driving roller 62 is a hard roller made of a rigid material (such as metal) and the other is an elastic roller made of a soft material (elastic rubber or resin materials such as foamed resin).

When transferring a toner image from the intermediate transfer belt 61 onto a recording sheet with the transfer roller 10, toner may remain on the intermediate transfer belt 61 without being transferred onto the recording sheet. The toner that has remained on the intermediate transfer belt 61 may cause mixture of colors in subsequent processes. Therefore, the toner that has remained on the intermediate transfer belt 61 is removed and recovered by the intermediate transfer belt cleaning unit 65. More specifically, the intermediate transfer belt cleaning unit 65 is provided with a cleaning member (e.g., a cleaning blade) that is in contact with the intermediate transfer belt 61. The idle roller 63 supports the intermediate transfer belt 61 from the inside (back face side), and the cleaning member is in contact with the intermediate transfer belt 61 so as to press against it toward the idle roller 63 from the outside.

A pre-transfer charging unit 8 includes a pre-transfer charger (PTC), and is provided near the intermediate transfer belt 61 on the upstream side from the transfer nip between the transfer roller 10 and the intermediate transfer belt 61 and on the downstream side from the photosensitive units 4 in the movement direction M of the intermediate transfer belt 61.

Incidentally, the toner images that are transferred from the photosensitive drums 3 onto the intermediate transfer belt 61 include halftone areas or solid areas, or include areas having different numbers of toner layers, and therefore the charge level may vary from area to area. Furthermore, the charge level within a toner image on the intermediate transfer belt 61 after the first transfer may be varied by exfoliation discharges generated in a gap on the downstream side adjacent to the first transfer portion in the movement direction M of the intermediate transfer belt 61. The variations in the charge level in the same toner image of this kind decrease the transfer margin when transferring a toner image on the intermediate transfer belt 61 onto a sheet.

For this reason, the pre-transfer charging unit 8 is used to charge a toner image uniformly before transferring it onto a sheet, so that the variations in the charge level in the same toner image are cancelled, which makes it possible to improve the transfer margin in the second transfer.

The paper feed tray 81 is a tray accommodating in advance recording sheets on which an image is to be formed (printed), and is provided below the light exposure unit 1 in the apparatus body 110. On the manual paper feed tray 82, recording sheets on which an image is to be formed (printed) are placed. The paper discharge tray 91 is provided above the image forming portion 102 in the apparatus body 110, and recording sheets on which an image has been formed (printed) are accumulated face-down on the paper discharge tray 91.

Furthermore, the apparatus body 110 is provided with a sheet conveying path S for conveying a recording sheet that has been conveyed from the paper feed tray 81 or the manual paper feed tray 82 and has passed the transfer roller 10 and the fixing unit 7 to the paper discharge tray 91. Arranged in the vicinity of the sheet conveying path S are pickup rollers 11*a* and 11*b*, a plurality of conveying rollers 12*a* to 12*d*, a registration roller 13, the transfer roller 10, a heat roller 71 and a pressing roller 72 of the fixing unit 7.

The conveying rollers 12*a* to 12*d* are small rollers for promoting and assisting conveying of the recording sheets, and are provided along the sheet conveying path S. The pickup roller 11*a* is provided in the vicinity of the paper feed tray 81 on the sheet supply side for picking up the recording sheets one by one from the paper feed tray 81 and supplies the sheets to the sheet conveying path S. Similarly, the pickup roller 11*b* is provided in the vicinity of the manual paper feed tray 82 on the sheet supply side for picking up the recording sheets one by one from the manual paper feed tray 82 and supplies the sheets to the sheet conveying path S.

The registration roller 13 temporarily holds the recording sheet that is being conveyed in the sheet conveying path S. Then, the registration roller 13 conveys the recording sheet to the transfer roller 10 at a timing at which the leading edge of the toner image on the photosensitive drums 3 is aligned with the leading edge of the recording sheet.

The fixing unit 7 fixes an unfixed toner image onto the recording sheet, and includes the heat roller 71 and the pressing roller 72 that serve as fixing rollers. When being rotated, the heat roller 71 conveys the recording sheet while sandwiching the recording sheet along with the pressing roller 72 that idly rotates. The heat roller 71 is heated with a heater 71*a* provided inside it, and is maintained at a predetermined fixing temperature based on a signal from a temperature detector 71*b*. The heat roller 71 heated with the heater 71*a* performs thermo-compression bonding of a multicolor toner image transferred onto the recording sheet on the recording sheet along with the pressing roller 72, so that the multicolor toner image is melted, mixed, and pressed and thus is thermo-fixed onto the recording sheet. The fixing unit 7 is also provided with an external heating belt 73 for heating the heat roller 71 from the outside.

In the image forming apparatus 100 configured in the above described manner, when there is a request for simplex printing on a recording sheet, a recording sheet supplied from the paper feed tray 81 or 82 is conveyed to the registration roller 13 with the conveying roller 12*a* provided along the sheet conveying path S, and is conveyed with the transfer roller 10 at a timing on which the leading edge of the recording sheet is aligned with the leading edge of the toner image on the intermediate transfer belt 61, and then the toner image is transferred onto the recording sheet. Thereafter, the recording sheet passes the fixing unit 7 so that unfixed toner on the recording sheet is melted by heat and adheres to the recording sheet, and then the recording sheet is discharged onto the paper discharge tray 91 through the conveying roller 12*b*.

When there is a request for duplex printing on a recording sheet, the simplex printing as described above is completed, and in a state where the tailing edge of the recording sheet that has passed the fixing unit 7 is positioned between the last conveying roller 12*b* and a branching portion Sa on the sheet conveying path S, the conveying roller 12*b* is reversely rotated, so that the recording sheet is guided to the conveying rollers 12*c* and 12*d*. Then, the recording sheet that has been conveyed to the transfer nip through the registration roller 13 undergoes printing on its back face, and then is discharged onto the paper discharge tray 91.

Regarding Resin Frame

Figure 2:
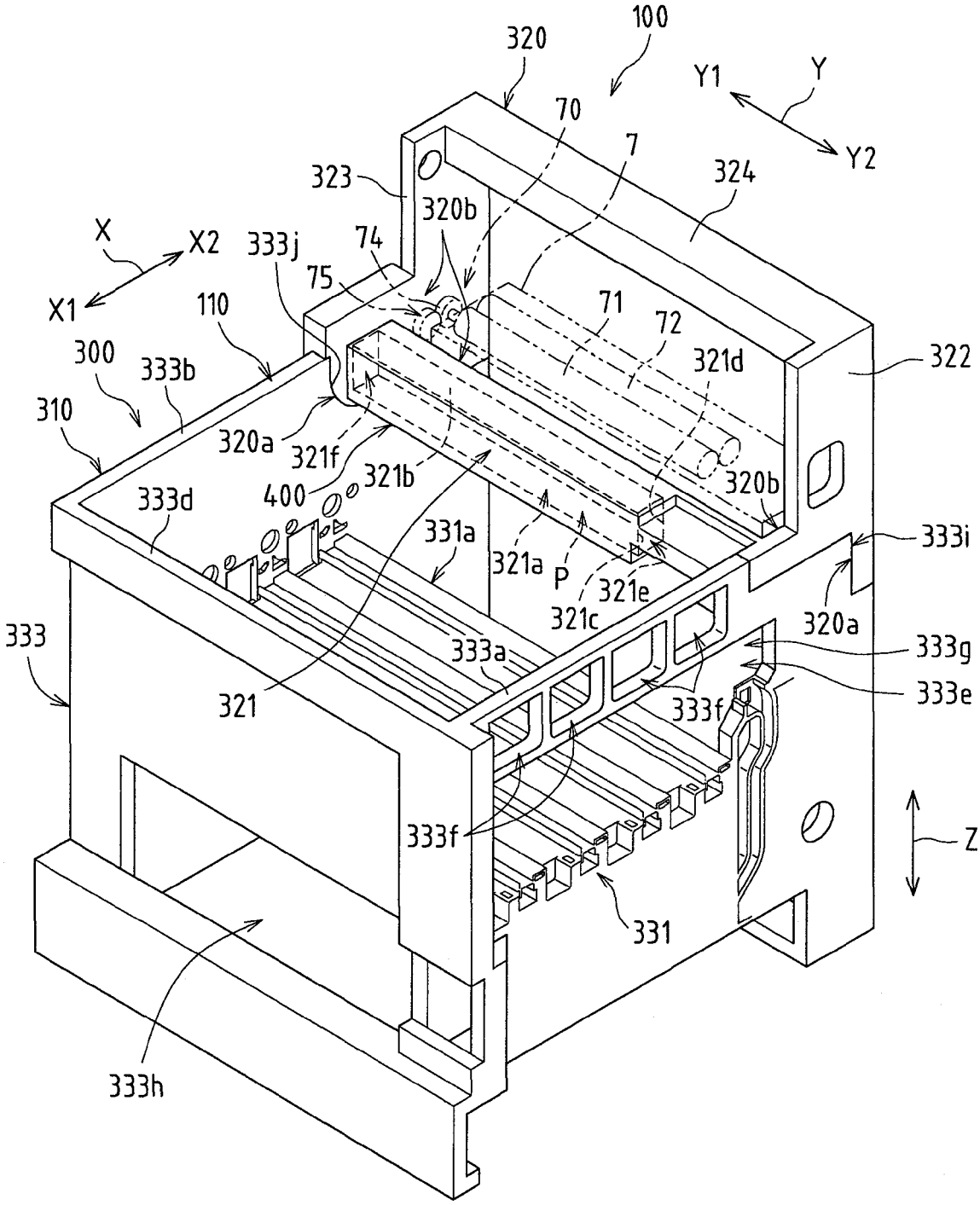
FIG. 2 is a schematic isometric view of a resin frame constituting a duct in the image forming apparatus shown in FIG. 1 when viewed diagonally down from the upper front left.
Figure 3:
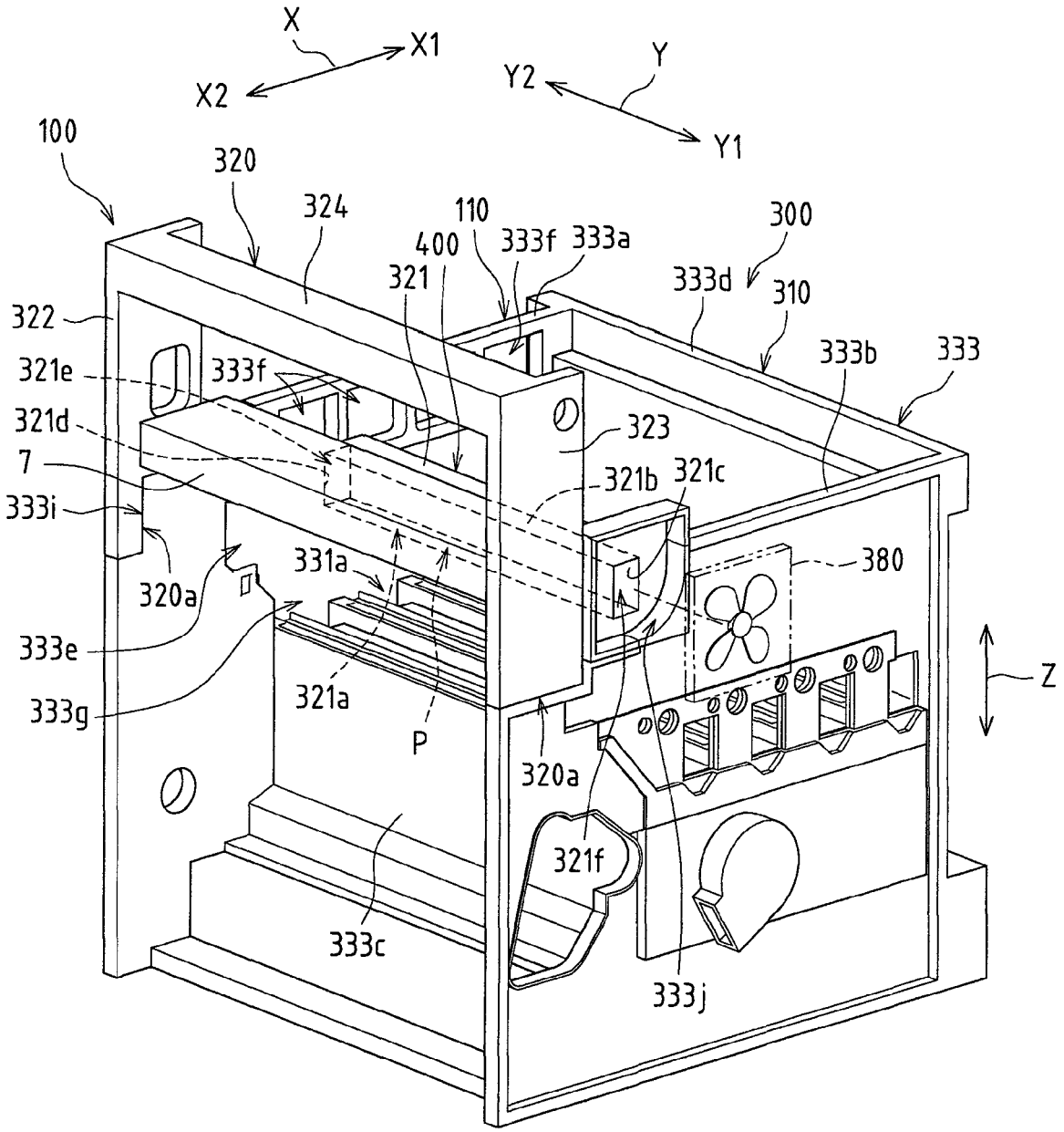
FIG. 3 is a schematic isometric view of the resin frame to which a fixing unit is fitted shown in FIG. 2 when viewed diagonally down from the upper back right.
Figure 4:
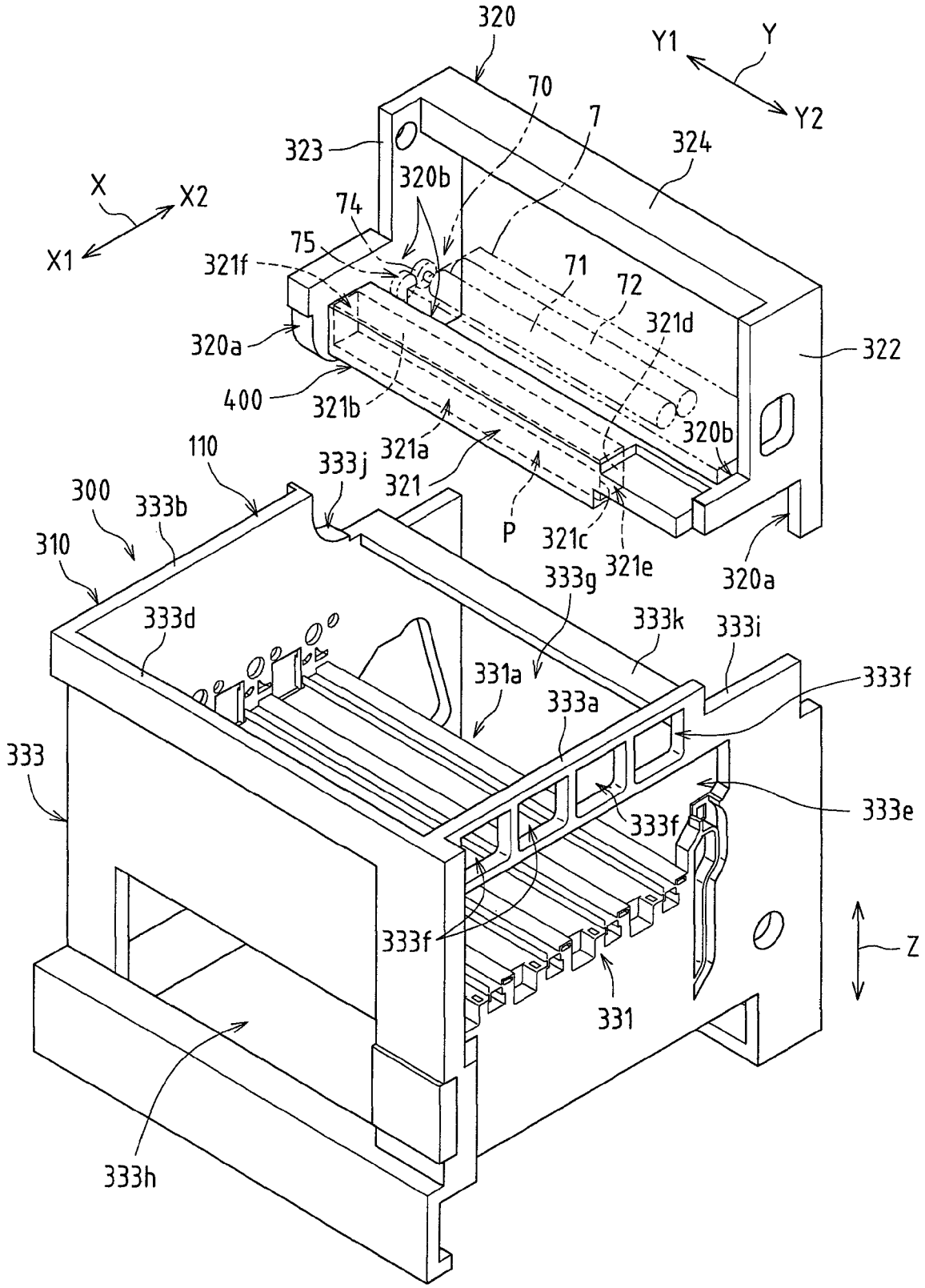
FIG. 4 is a schematic exploded isometric view of the resin frame shown in FIG. 2 when viewed diagonally down from the upper front left.
Figure 5:
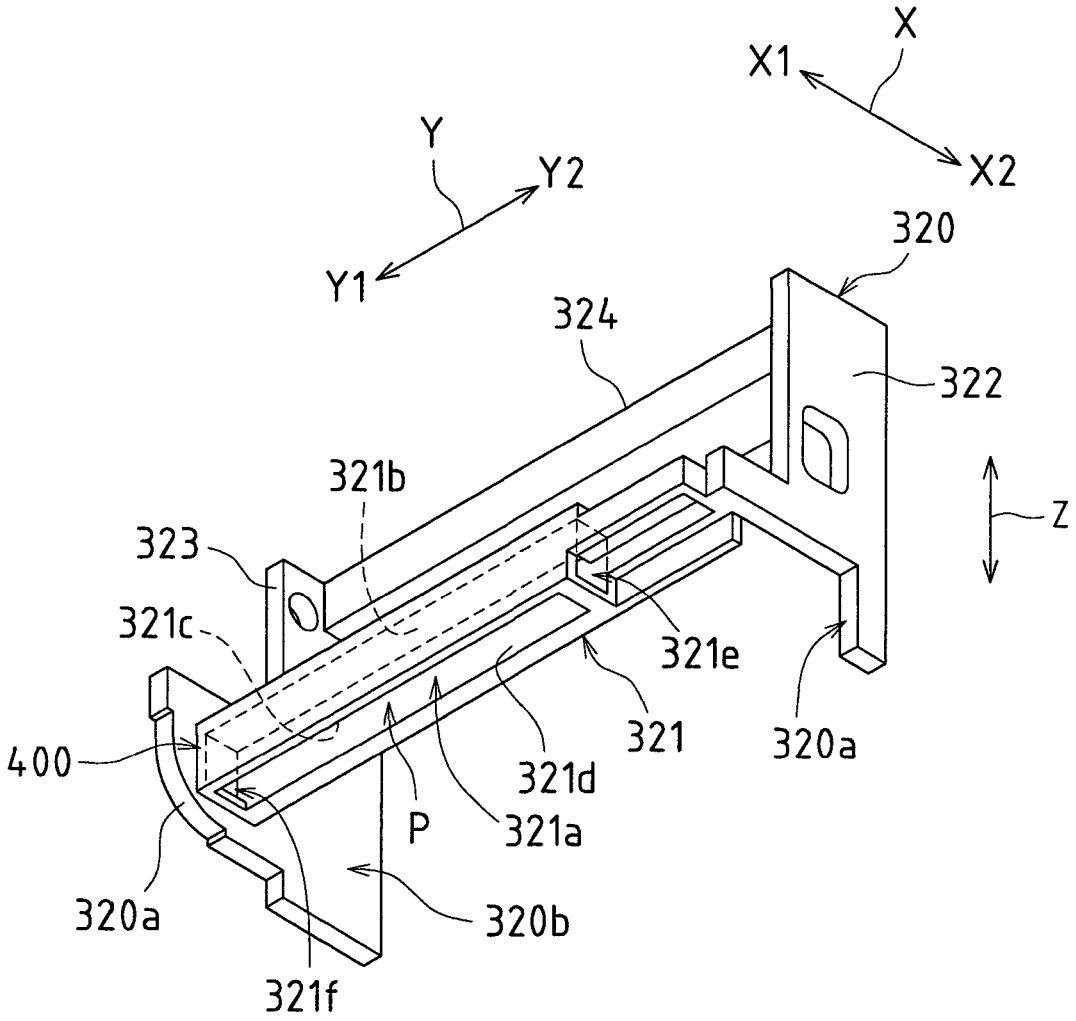
FIG. 5 is a schematic isometric view of a fixing unit attachment frame shown in FIG. 4 when viewed diagonally up from the lower front left.

FIG. 2 is a schematic isometric view viewed diagonally down from the upper front left of a resin frame 300 including a duct 400 in the image forming apparatus 100 shown in FIG. 1. FIG. 3 is a schematic isometric view of the resin frame 300 to which a fixing unit 7 is fitted shown in FIG. 2 when viewed diagonally down from the upper back right. FIG. 4 is a schematic exploded isometric view of the resin frame 300 shown in FIG. 2 when viewed diagonally down from the upper front left. FIG. 5 is a schematic isometric view of a fixing unit attachment frame 320 shown in FIG. 4 when viewed diagonally up from the lower front left. Herein, "left" and "right" refer to respectively left and right when viewed from the front of the apparatus body 110. An arrow X in the drawings indicates the width direction of the apparatus body 110, an arrow Y indicates the depth direction of the apparatus body 110, and an arrow Z indicates the vertical direction of the apparatus body 110.

The image forming apparatus 100 of this embodiment further includes a resin frame 300 made of resin and a duct 400. The resin frame 300 is formed integrally with a synthetic resin.

As shown in FIGS. 2 to 5, the duct 400 serves to allow air to flow in a space between at least one unit (the intermediate transfer belt unit 6 and the toner cartridge units 21 in this embodiment) of the plurality of image forming units 200 and the fixing unit 7 (see FIG. 1). More specifically, the duct 400 is disposed so as to shield at least one unit (the intermediate transfer belt unit 6 and the toner cartridge units 21 in this embodiment) of the image forming units 200 from the heat emitted from the fixing unit 7.

The resin frame 300 includes a main frame 310 to which the image forming units 200 (herein, light exposure unit 1, development units 2, photosensitive units 4, intermediate transfer belt unit 6, pre-transfer charging unit 8 and toner cartridge units 21) are attached, and a fixing unit attachment frame 320 that is separate from the main frame 310 and to which the fixing unit 7 (see FIGS. 2 and 4) is attached. The main frame 310 and the fixing unit attachment frame 320 are fixed with each other with a fastening member such as screws in this embodiment. Alternatively or moreover, the main frame 310 and the fixing unit attachment frame 320 may be fixed to each other with fitting engagement.

Furthermore, the fixing unit attachment frame 320 has a duct portion 321 that constitutes at least a part of the duct 400.

In this embodiment, the main frame 310 and the fixing unit attachment frame 320 are formed of the same kind of resin.

The resin materials that can be used for the main frame 310 and the fixing unit attachment frame 320 are, for example, resin materials having excellent strength and heat resistance properties, such as resin obtained by blending a polymer alloy of polycarbonate resin and ABS (acrylonitrile butadiene styrene) with a glass material such as glass fibers (specifically, 25% blending), more specific example of which is DN1525BM manufactured by TEIJIN LIMITED.

In this embodiment, the fixing unit attachment frame 320 has a main frame attachment portion 320*a* for attachment to the main frame 310, and a fixing unit attachment portion 320*b* for attachment to the fixing unit 7 at a different position from the main frame attachment portion 320*a*.

More specifically, the fixing unit attachment frame 320 is provided on one side (herein, upper end portion on the right side (X2 side)) in the width direction X of the apparatus body 110. Furthermore, the fixing unit attachment frame 320 has an L-shaped front member 322 that is provided on the front side of the apparatus body 110, an L-shaped back member 323 that is provided on the back side of the apparatus body 110, and an upper member 324 that is coupled integrally to the upper ends of the front member 322 and the back member 323. The duct portion 321 is coupled integrally to the left ends (X1 side) of the front member 322 and the back member 323. The main frame attachment portion 320*a* is provided on the lower side of the front member 322 and the back member 323. The fixing unit attachment portions 320*b* are on the inside of the front member 322 and the back member 323 and on the right side (X2 side) of the duct portion 321.

In this embodiment, the fixing unit 7 has a shape that is elongated in the axis direction (depth direction Y of the apparatus body 110) of the heat roller 71 and the pressing roller 72 (see FIGS. 2 and 4). The duct 400 is provided so as to extend along the length direction (depth direction Y of the apparatus body 110) of the fixing unit 7 and be adjacent to the fixing unit 7.

In this embodiment, the duct portion 321 has a box-like shape having an opening portion 321*a* that is open in one direction (herein, lower face).

In this embodiment, the fixing unit attachment frame 320 has at least one face (herein, inner upper face 321*b*, first inner side face 321*c* and second inner side face 321*d*) that that constitutes part of the duct 400, and the inner upper face 321*b*, the first inner side face 321*c* and the second inner side face 321*d* serve also as reinforcing portions (herein, top plate having the inner upper face 321*b*, first side plate having the first inner side face 321*c* and second side plate having the second inner side face 321*d*). More specifically, the inner upper face 321*b* extends in the depth direction Y of the apparatus body 110, the first inner side face 321*c* on the left side (X1 side) and the second inner side face 321*d* on the right side (X2 side) extend from the opposite ends in the short side direction (width direction X of the apparatus body 110) of the inner upper face 321*b* perpendicularly or substantially perpendicularly downward. An air intake port 321*e* for drawing in air by means of an exhaust fan 380 as described later is provided on one side (herein, front side (Y2 side)) of the duct 400 in the depth direction Y of the apparatus body 110. An air discharge port 321*f* for discharging air by means of the exhaust fan 380 is provided on the other side (herein, back side (Y1 side)) of the duct 400 in the depth direction Y of the apparatus body 110. When molding the duct portion 321, a die can be inserted from the opening portion 321*a*.

In this embodiment, the opening portion 321*a* of the duct portion 321 is blocked by a part (not shown) of a member (herein, a member constituting the intermediate transfer belt unit 6) that is located adjacent to the duct 400. Thus, in the duct 400, air can flow reliably from the air intake port 321*e* to the air discharge port 321*f*. It should be noted that the duct 400 may have the duct portion 321 and a blocking member (e.g., sheet-like member of, for example, a seal or a film) that blocks the opening portion 321*a* of the duct portion 321. In this case, for example, the opening portion 321*a* can be closed by providing the blocking member in a peripheral portion of the duct 400.

Therefore, in the duct 400, a space P defined by the inner upper face 321*b*, the first inner side face 321*c*, the second inner side face 321*d* and a part of a member (not shown) adjacent to the duct 400 is formed so that air flows in the space P from the air intake port 321*e* to the air discharge port 321*f*.

More specifically, the photosensitive units 4 are supported by the main frame 310, and are inserted and removed in the depth direction Y of the apparatus body 110. The main frame 310 has a base 331 and a side plate portion 333. The base 331 has a support face 331*a* for supporting the photosensitive units 4. The side plate portion 333 has a first side plate portion 333*a* that is positioned on the front side of the apparatus body 110, a second side plate portion 333*b* that is positioned on the back side of the apparatus body 110, a third side plate portion 333*c* that is positioned on the right side of the apparatus body 110, and a fourth side plate portion 333*d* that is positioned on the left side of the apparatus body 110.

In this embodiment, the resin frame 300 is a resin frame configured to have an H-shape in cross section in which the plate-like base 331 is provided perpendicularly to the side plate portion 333 (herein, the first side plate portion 333*a* to fourth side plate portion 333*d*) between the upper end and the lower end in the vertical direction Z. More specifically, the first side plate portion 333*a* to fourth side plate portion 333*d* (corresponding to the vertical line in the H-shape) are coupled integrally to the plate-like base 331 (corresponding to the horizontal line in the H-shape) along the horizontal direction substantially in the middle position of the vertical direction Z.

The plurality of development units 2 are inserted and removed in the depth direction Y of the apparatus body 110 with the respective photosensitive units 4 interposed between the respective development units 2 in the width direction X of the apparatus body 110 (see FIG. 1).

In this embodiment, the photosensitive units 4 and the development units 2 are a plurality of units having shapes that are elongated in the direction that is perpendicular to the first side plate portion 333*a* and the second side plate portion 333*b* (depth direction Y of the apparatus body 110) between the first side plate portion 333*a* and the second side plate portion 333*b*. The plurality of photosensitive units 4 and the plurality of development units 2 are provided alternatively side by side in the image forming direction M (movement direction of the intermediate transfer belt 61) (see FIG. 1), that is, in the width direction X of the apparatus body 110 in this embodiment.

The first side plate portion 333*a* is provided with an opening portion 333*e* that is open such that the plurality of development units 2 and the plurality of photosensitive units 4 can be inserted therein, and a plurality of opening portions 333*f* that correspond to the respective toner cartridge units 21, and that are open so that the toner cartridge units 21 can be inserted in the corresponding opening portions. The third side plate portion 333*c* is provided with an opening portion 333*g* that is open such that one end portion (herein, right end portion) of the intermediate transfer belt unit 6 can project toward the outside in the width direction X. The fourth side plate portion 333*d* is provided with an opening portion 333*h* (see FIGS. 2 and 4) that is open so that components of various electrical systems such as a control substrate can be arranged. An attachment portion 333*i* at which the fixing unit attachment frame 320 is attached at its front lower portion is provided on the right upper side of the first side plate portion 333*a*, and an attachment portion 333*j* at which the fixing unit attachment frame 320 is attached at its back lower portion is provided on the right upper side of the second side plate portion 333*b*. An attachment portion 333*k* (see FIG. 4) at which the fixing unit attachment frame 320 is attached at its left lower portion spans from the attachment portion 333*i* to the attachment portion 333*j*.

In this embodiment, the fixing unit attachment frame 320 is provided with a driving member 70 (see FIGS. 2 and 4) for rotating components in the fixing unit 7. Examples of the driving member 70 include a driving transmission member such as a driving gear unit that transmits rotational driving from the apparatus body 110 to the heat roller 71 and the pressing roller 72 in the fixing unit 7, and an attachment member of a driving motor for rotating the fixing rollers. In this embodiment, the fixing unit attachment frame 320 is provided with a driving gear unit 75 including a driving gear that is engaged in a fixing gear 74 of the heat roller 71.

In this embodiment, a rib 420 (not shown in FIGS. 2 to 5, see FIG. 6) having a curvature in an air flowing direction (herein, the depth direction Y of the apparatus body 110) is provided inside the duct 400.

Figure 6:
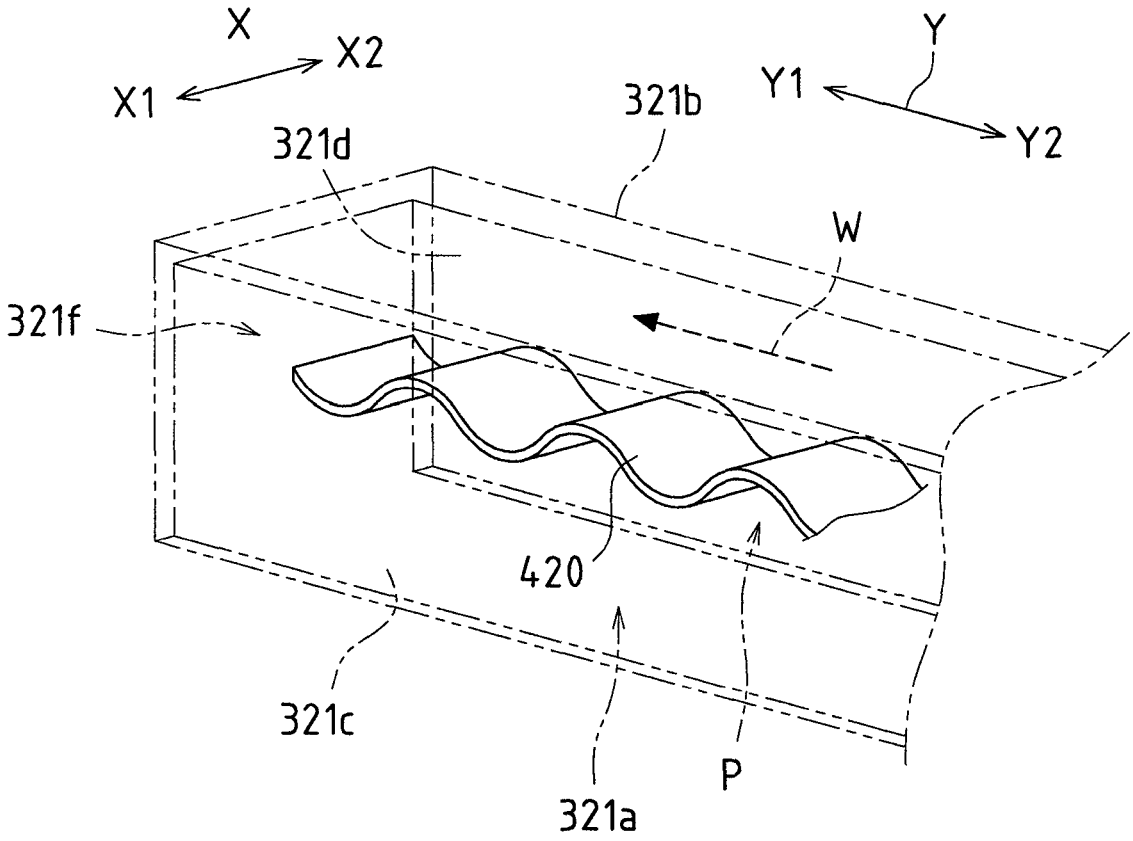
FIG. 6 is a schematic isometric view of an enlarged portion of a rib provided inside the duct shown in FIGS. 1 to 5.

FIG. 6 is a schematic isometric view of an enlarged portion of the rib 420 provided inside the duct 400 shown in FIGS. 1 to 5.

As shown in FIG. 6, the rib 420 has a curvature in the air flowing direction W. The rib 420 is elongated in the depth direction Y and corrugated in the depth direction Y (the air flowing direction W). In this embodiment, the rib 420 is provided on the second inner side face 321*d*. It should be noted that the rib 420 can be provided in at least one face of the inner upper face 321*b*, the first inner side face 321*c* and the second inner side face 321*d*. The rib 420 may be coupled integrally to the opposing face. Furthermore, a plurality of the ribs 420 may be provided in at least one face of the inner upper face 321*b*, the first inner side face 321*c* and the second inner side face 321*d*. When a plurality of the ribs 420 are provided, the ribs 420 may be provided in parallel and/or in series.

In this embodiment, the image forming apparatus 100 is provided with the exhaust fan 380 for discharging air from the space P in the duct 400. More specifically, the exhaust fan 380 (see FIG. 3) for sucking air from the space P via the air discharge port 321*f* is provided in a portion facing the air discharge port 321*f* on the back side (Y1 side) of the fixing unit attachment frame 320.

In the light exposure unit image forming apparatus 100 described above, when the exhaust fan 380 is driven, the air is moved through the air intake port 321*e* into the space P by the exhaust fan 380, and is discharged from the air discharge port 321*f* through the exhaust fan 380 to the outside.

According to the image forming apparatus 100 of this embodiment, since the resin frame 300 includes the main frame 310 to which the image forming unit 200 is attached, and the fixing unit attachment frame 320 that is separate from the main frame 310 and to which the fixing unit 7 is attached, the main frame 310 that constitutes part of the resin frame 300 can be molded with a die for the main frame 310, the fixing unit attachment frame 320 that constitutes part of the resin frame 300 can be molded with a die for the fixing unit attachment frame 320 that is different from the die for the main frame 310. This can simplify the die structure for molding the resin frame 300. In addition, the duct 400 is provided to allow air to flow between the image forming unit 200, for example, image forming units in the vicinity of the fixing unit 7 (the intermediate transfer belt unit 6 and the toner cartridge units 21 in this embodiment) and the fixing unit 7. Therefore, heat transmission from the fixing unit 7 to the image forming unit 200, for example, image forming units in the vicinity of the fixing unit 7 (the intermediate transfer belt unit 6 and the toner cartridge units 21 in this embodiment) can be suppressed. In addition to that, heat transmission from the fixing unit 7 to image forming units (e.g., the photosensitive units 4, the development units 2 and the like) that are further away from the fixing unit 7 than the intermediate transfer belt unit 6 and the toner cartridge units 21, the intermediate transfer belt unit 6, the toner cartridge units 21 and the duct 400 being interposed between said image forming units and the fixing unit 7, can be suppressed. Furthermore, the fixing unit attachment frame 320 has the duct portion 321 constituting at least a portion of the duct 400, and therefore the strength of the fixing unit attachment frame 320 can be improved.

In this embodiment, the main frame 310 and the fixing unit attachment frame 320 are able to have a same shrinkage rate by forming the main frame 310 and the fixing unit attachment frame 320 with the same kind of resin. This makes it possible to reduce deformation between the main frame 310 and the fixing unit attachment frame 320 that is caused by heat of the fixing unit attachment frame 320.

In this embodiment, the fixing unit attachment frame 320 has the main frame attachment portion 320*a* and the fixing unit attachment portion 320*b*, which is located in a different position from the main frame attachment portion 320*a*. This makes it possible for the fixing unit attachment frame 320 to be attached to the main frame 310 through the main frame attachment portion 320*a*, and to be attached to the fixing unit 7 through the fixing unit attachment portion 320*b* at a different position from the main frame attachment portion 320*a*. Thus, the main frame 310 can be a common component used for various models of the fixing unit 7 having different structures, which accomplishes cost reduction.

In this embodiment, the driving member 70 is provided in the fixing unit attachment frame 320. Therefore, by varying the driving member 70 with models having different process speeds, the main frame 310 can be a common component used for models having different process speeds, which accomplishes cost reduction.

In this embodiment, the duct portion 321 has a box-like shape that is open in one direction, and therefore the strength of the fixing unit attachment frame 320 having the box-like shaped duct portion 321 can be improved.

In this embodiment, the strength of the fixing unit attachment frame 320 can be further improved by the reinforcing portion (the top plate having the inner upper face 321*b*, the first side plate having the first inner side face 321*c* and the second side plate having the second inner side face 321*d*) that is served by at least one face that constitutes part of the duct 400 in the fixing unit attachment frame 320.

In this embodiment, the duct 400 that is provided adjacent to the fixing unit 7 and extending in the length direction (the depth direction Y of the apparatus body 110) of the fixing unit 7 makes it possible to cool the fixing unit 7 entirely along the length direction (the depth direction Y of the apparatus body 110) of the fixing unit 7.

In this embodiment, the rib 420 has a curvature in the air flowing direction, and therefore the surface area of the rib 420 can be increased in a state where air flow is hardly interrupted by the rib 420, and thus air can come in contact with the surface of the rib 420 efficiently, which improves the heat dissipation effect due to the rib 420. In addition, the rib 420 and the duct portion 321 are formed integrally into one piece, which makes it possible to improve the strength of the fixing unit attachment frame 320 as well as the strength of the duct 400.

The present invention can be embodied and practiced in other different forms without departing from the spirit and essential characteristics thereof. Therefore, the above-described embodiments are considered in all respects as illustrative and not restrictive. The scope of the invention is indicated by the appended claims rather than by the foregoing description. All variations and modifications falling within the equivalency range of the appended claims are intended to be embraced therein.

What is claimed is:

1. An image forming apparatus comprising:

a resin frame made of a resin, an image forming unit, a fixing unit, a duct for allowing air to flow between the image forming unit and the fixing unit, wherein the resin frame includes a main frame to which the image forming unit is attached, and a fixing unit attachment frame that is separate from the main frame and to which the fixing unit is attached, the fixing unit attachment frame being attachable to the main frame, the fixing unit attachment frame has a front member that is provided on a front side of an apparatus body of the image forming apparatus, a back member that is provided on a back side of the apparatus body of the image forming apparatus, an upper member that is coupled integrally to upper ends of the front member and the back member; and a duct portion that is coupled integrally to the lower ends of the front member and the back member, and that constitutes at least one part of the duct, the upper member is provided on a side of the front member and the back member, the duct portion is provided on a side of the front member and the back member which is opposite to the side of the front member and the back member on which the upper member is provided, and thereby the duct portion and the upper member are provided in diagonal relationship to one another in the fixing unit attachment frame, the duct portion is a box-shaped duct portion that includes an opening in a longitudinal face of the duct portion, the opening being an entire face of the box-shaped duct portion, the fixing unit has a fixing member and has a shape that is elongated to the axis direction of the fixing member, and the duct is provided adjacent to the fixing unit and extending in the length direction of the fixing unit.

2. The image forming apparatus according to claim 1, wherein the main frame and the fixing unit attachment frame are formed of a same kind of resin.

3. The image forming apparatus according to claim 1, wherein the fixing unit attachment frame comprises a main frame attachment portion for attachment to the main frame and a fixing unit attachment portion for attachment to the fixing unit at a different position from the main frame attachment portion, the main frame attachment portion is provided on lower sides of the front member and the back member, and the fixing unit attachment portion is provided inside the front member and the back member.

4. The image forming apparatus according to claim 1, wherein the fixing unit attachment frame is provided with a driving member for rotating the fixing unit.

5. The image forming apparatus according to claim 1, wherein the fixing unit attachment frame has at least one face that constitutes part of the duct, and the at least one face serves also as a reinforcing portion.

6. The image forming apparatus according to claim 1, wherein the duct portion is configured to be a box-like shaped duct portion that is open in one direction.

7. The image forming apparatus according to claim 1, wherein a rib having a curvature in an air flowing direction is provided inside the duct, the rib is formed integrally with the duct portion, and the rib is elongated to the air flowing direction and corrugated in the air flowing direction.

* * * * *